US005568703A

United States Patent [19]

Frank et al.

[11] Patent Number: 5,568,703

[45] Date of Patent: Oct. 29, 1996

[54] ROOF WINDOW

[75] Inventors: Karl-Heinz Frank, Waldenbuch; Johann Schneider; Volker Wöhrn, both of Leinfelden-Echterdingen, all of Germany

[73] Assignee: Roto Frank AG, Leinfelden-Echterdinger, Germany

[21] Appl. No.: 429,205

[22] Filed: Apr. 26, 1995

[30] Foreign Application Priority Data

Apr. 26, 1994 [DE] Germany ..... 9406929 U

[51] Int. Cl.[6] ..... E05D 15/48

[52] U.S. Cl. ..... 49/153; 49/192; 49/253; 49/386

[58] Field of Search ..... 49/386, 192, 153, 49/246, 250, 253, 252, 261, 390; 52/72

[56] References Cited

U.S. PATENT DOCUMENTS 4,055,024 10/1977 Frank ..... 49/153
4,480,406 11/1984 Frank ..... 49/192 X
4,486,978 12/1984 Frank ..... 49/153

FOREIGN PATENT DOCUMENTS 2414887 10/1974 Germany .
2708785 10/1978 Germany .

*Primary Examiner*—Philip C. Kannan
*Attorney, Agent, or Firm*—Pepe & Hazard

[57] ABSTRACT

A skylight has a sash, a casement and [spring-loaded⇆ carrier arms which are mounted at one end to the casement and at the other end on a pivot bearing on the sash side rail. The sash has spindles cooperating with a U-shaped runner on the side member of the casement. A cover plate borders the channel of the runner and overlaps the spindles when the sash is in the swinging position. When the sash is in the closed position [and the swinging position], the spindles is outside the working range of the cover plate. When the sash is opened and the carrier arm is coupled thereto, it tilts on the pivot bearing. When opened with the sash uncoupled from the carrier arms, the spindle move in the grooves of the runner toward the lower edge of the casement, and the pivot bearing on the casement is lifted off and the sash swings open. The spindles are positioned on the side rail of the sash and move longitudinally when they are seated in individual settings by movement of the handle on the sash cross member.

6 Claims, 2 Drawing Sheets

ROOF WINDOW

BACKGROUND OF THE INVENTION

The present invention is directed to a skylight with a sash mounted on the casement by means of spring-loaded carrier arms which are jointed and are mounted on one end on a hinged bearing attached to the top of the casement, and, on the other end, roughly in the middle of the sash, to a pivot bearing on the side beam of the sash, and the sash has a spindle between the pivot bearing and its upper edge on each side rail that interacts with a runner that is U-shaped in cross section and is placed on the side pin of the casement; and wherein the rail's cover plate adjacent the sash and bordering a groove overlaps the spindles when the sash is in the swinging position and, when the sash is in the closed position and the swinging position, the spindle is outside the working range of the cover plate, and, wherein, after activating a handle attached to the cross member of the sash when the sash is opened and the carrier arm is coupled with the sash, the sash tilts on the hinged bearing and, when opened with the sash uncoupled from the carrier arms, the spindles move in the rail groove toward the lower edge of the casement and the pivot bearing on the sash side of the casement comes off and the sash swings open.

In such a skylight, known from German Offenlegungschnift 2 708 785, there is the option of the sash being in the hinged setting or the swinging setting when opened. To make hinged opening possible, the sash is coupled to the carrier arms so that the sash moves synchronously with the carrier arms attached to it on the hinged axis formed by hinged bearings at the top of the casement. The spindles, which are attached to the sash permanently, describe a circular arc on the hinged axis. The runner on the casement side has a recess at its upper end so that the spindles can move in and out of the runner. As a result of this recess, the cover plate and hence the runner groove end before the area where the spindles tilt.

If the sashes are swung open after the sash and the carrier arm are uncoupled, the spindle remains unchanged near the recess on the runner and thus in front of the groove opening. Now when it is opened in the swinging position, no information of any kind is transmitted to the spindle so that there is a risk that the spindles will come off the runner again through the recess and not go through the grove opening into the groove itself and slide down in it, as is necessary to make the sash swing open. In order to limit the risk of improper adjustment when the sash is being opened, the runner has a molded spring pin which should counteract the holding force that makes the spindle come off the runner when the sash is swung open. However, there is a conflict for the holding force since, on the one hand, it must let the spindle move on and off the runner when the sash is moving on its hinges, but, on the other hand, it must keep it from coming off when the sash is supposed to swing open. Thus, for example, depending on the arrangement and design of the weight-balancing device on the sash, forces can act on the sash when it is opened that tend to lift the top of the sash off the casement and then also overcome the resistance exerted by the spring pin, whereupon the sash opens wrong and hangs uncontrolled by the pivot bearing on the carrier arm side.

The task of the invention is to make the desired method of opening the sash on a conventional skylight more reliable.

SUMMARY OF THE INVENTION

The invention accomplishes this task by taking a conventional skylight, arranging the spindles on the side rails of the sash so they can move longitudinally, and having only one spindle setting which can be set by means of a handle.

The spindle is now arranged on the side rail of the sash so it can change places, and the spindles are moved by turning the handle. So it is possible to assign certain spindle settings to the individual settings on the handle. In the hinged spindle setting, with the sash lying against the casement, for example, the spindles are somewhat in front of the opening of the runner groove and thus outside the working range of the cover plate for the runner. When the sash is opened on its hinges, the spindles can then move by on the groove and are unhindered by the additional forces exerted in the spindles. If the sash is lying on the casement and the handle is moved further in its swing-open setting, the spindles must move toward the lower cross member of the sash, go through the runner groove opening and into the groove, so that, in the swing setting, the spindles project over the respective cover plate of the runner. When the sash is then opened, the spindles can no longer come off the runner. As a result of the spindles being locked from coming off the casement when the carrier arm is lifted off the sash and the casement, on whose free end the sash is jointed and connected by means of pivot bearings, the spindles slide down in the runner groove until the desired swing-open setting of the sash is reached.

The spindles can be moved down in the groove until they reach the stop at the lower end of the groove. The sash is then in the cleaning position, in which the outside of the sash is accessible from the inside of the room.

To keep the sash in the swing-open position when it is under the stress of environmental influences, the sash can be stopped opposite the carrier arms and/or a braking action can be used between the spindles and the runner, for example, by tightness.

In a previously used "Roto Alpine" skylight from ROTO FRANK AG, Leinfelden-Echterdingen, with a hinged-swing sash, the spindles are also mounted permanently on the sash. The sash has a brace, and a handle mounted on the lower horizontal cross member of the sash acts through a straddling gear on two movable drive rods that go in opposite directions and a corner brace on a drive rod mounted in the side rail. Near the lower cross member of the sash on the side rail, this drive rod holds a locking element designed as a closing tongue that works with a closing part attached to the casement. With the sash adjacent to the casement, the sash can be locked in the closed position by the locking element and the closing part. If the closing part has additional recesses, the sash can also be set in the hinged-ventilation position to the casement. On the free end of the drive rods assigned to the upper edge of the sash, a locking part designed as snaps is spring-mounted for coupling and uncoupling the sash with the carrier arms. Thus, a single handle can be used to lock the skylight, put it in the ventilation position, and couple and uncouple the sash from the carrier arms.

With this type of skylight that engages and disengages, it is convenient to connect the drive rods to the spindles as well, so that they can be made to move longitudinally and go into the individual settings with means that are already available, synchronized with other potential locking devices by a closing and a locking part.

Preferably, the spindle is attached to a flange, which is mounted in an undercut guide groove of a base plate set into the side rail of the sash recessed behind the drive rod, and the base plate is equipped with a longitudinal pin which has a catch for projecting over the drive rod in the area where the drive rod and the spindles meet. Thus, stresses acting on the spindles through the flange and the base plate are taken directly into the side rail of the sash frame. The drive rod is kept free of such stresses so that the movement of the drive rods is not affected. The longitudinal pin on the base plate connected to the projecting catch serves as an additional guide for the drive rods in the area where they are connected to the spindles; the catch secures this connecting point so the drive rod does not come off the connecting pin which is bent from the flange and interlocks in a recess on the drive rod.

The activation of the handle and thus the setting of the different positions of the spindle and the intended working sequences for the desired sash-opening movement take place with the sash adjacent to the casement. In practice, however, it can happen that the handle is also activated on purpose with the sash already open. In order to rule out such malfunctions, a safety device is used in the known way which completely locks the activation of the handle when the sash is open or only allows partial activation.

The possibility of a malfunction can also be taken into account consciously if it is made sure that no damage or functional disturbance to the skylight can occur. Such a device for preventing negative effects when the skylight is operated improperly advantageously consists of the facts that the cover plate of the runner groove ends before the area of the spindle in its swing-position forming a groove opening; that a slide is mounted on the cover plate that projects over the groove opening due to the action of a pressure spring almost up to the area where the spindles are in the hinged setting; and that the projecting end of the slide has an inclined surface on the top turned away from the groove, and the bottom is arranged parallel to the guide surface of the cover plate for the spindles. When the sash is adjacent to the casement, the spindles in all three settings—closed, tilted, swinging—are adjacent to the runner in front of the groove opening, thus outside the working range of the cover plate wherein the closed setting is up, followed by the tilted setting and the swinging setting. The window can tilt open unhindered by the runner. In the swing setting, the spindle is outside the groove in front of the groove opening, but projects over the bottom of the spring-loaded slide. This bottom forms a quasi-extension of the runner cover plate and prevents the spindle from coming off the casement so that the sash can swing open. When the sash is opened, the slide takes the spindle down and it then goes under the runner cover plate.

When the sash is tilted open, if the spindle-swing setting is accidentally set with the handle, the spindle hits an inclined surface on the slide projecting over the groove opening the next time the sash is closed. The spindle exerts a force component on the slide which pushes the slide back against the force of the pressure spring until the path of the spindle is free and the spindle gets back on the sliding surface of the runner in the area shortly before the groove opening. As soon as the force exerted on the slide by the spindles is removed, the slide is pushed out again as a result of the pressure spring and again covers the swing setting for the spindle which then is caught by the slide and secured against coming out of the casement when the sash is opened again. Thus, negative effects on the skylight itself are avoided even when the sash is not operated properly.

After the slide is pushed back when the spindle-swing setting is improper, in order to make it easier for the spindle to be overlapped by the slide again, a wedge-shaped surface is arranged on the transition from the bottom to the inclined surface of the slide which improves sliding on the spindles, especially those that are round in cross section.

It is convenient for the slide to be mounted in a housing molded on the runner and for the runner and slide to be produced as injection-molded parts so that they are easier to assemble and to produce because the runners and slide housings are produced in one piece, and at the same time a plastic can be selected with the desired friction co-efficients for the spindles, especially those made of metal.

BRIEF DESCRIPTION OF THE DRAWINGS

Other advantages and details will emerge from the drawings, which show an example of embodiment in schematic representation.

DETAILED DESCRIPTION OF THE ILLUSTRATED EMBODIMENT

Figure 1:
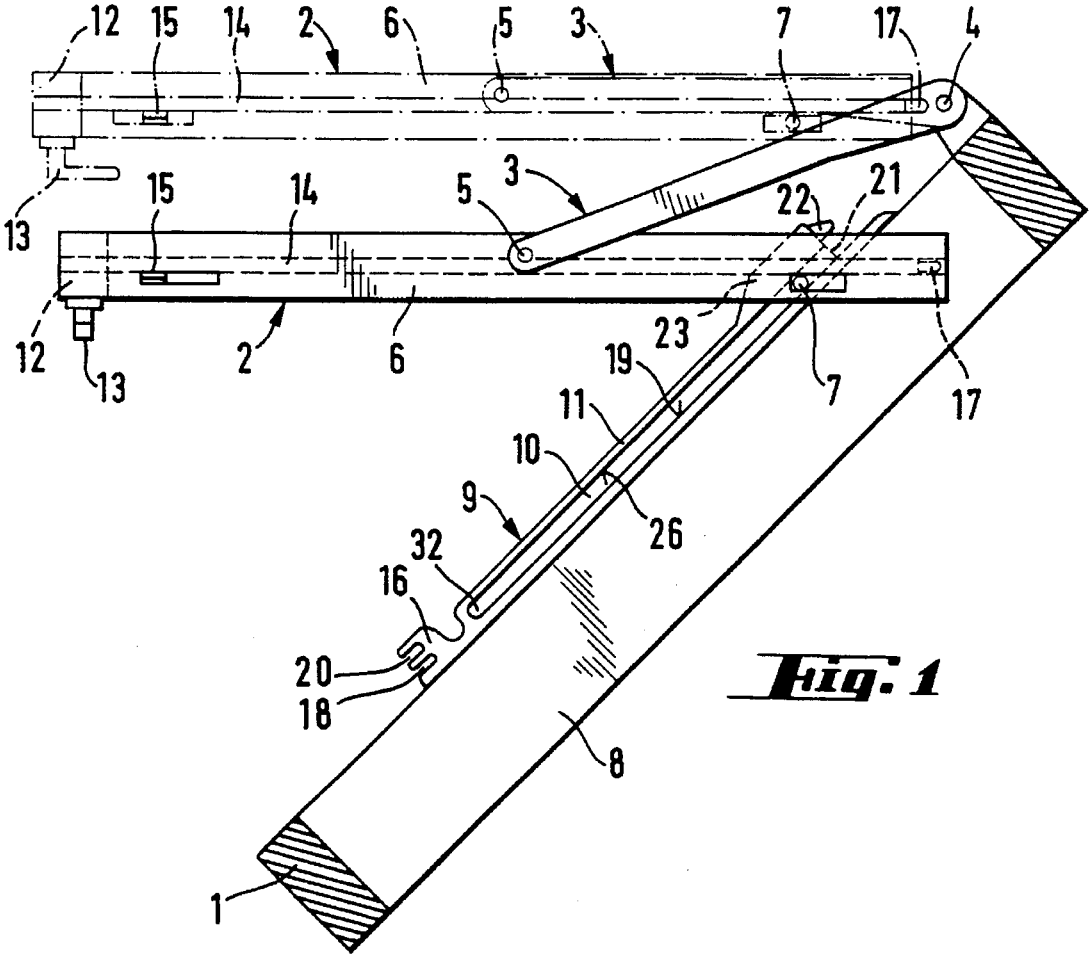
FIG. 1 illustrates a built-in skylight with a sash that swings open and tilts open.

The skylight in FIG. 1 consists of a casement 1 and a sash 2 pivotally connected thereto with carrier arms 3 mounted at one end on a hinged bearing 4 attached to the upper edge of the casement 1 and at the other end to the respective side rail 6 of the frame of the sash 2 by means of a pivot bearing 5 arranged approximately in the center of the sash 2. In the upper third of the length of the sash 2, between the pivot bearing 5 and the top edge of the sash 2 on each side rail 6, there is a spindle 7 which cooperates with a runner 9 set on the front of the side member 8 of the casement 1. The runner 9 has a basically U-shaped cross section providing a channel or groove 10 for holding the spindle 7 which projects from the cover plate 11 bordering the groove 10 and is secured against coming off the casement 1.

The handle 13 attached to the lower cross member 12 of the sash 2 can be put into three positions offset 90° from each other, namely in the closed setting, the tilt setting and swing-open setting. The handle 13 acts on a gear which consists, as known, of a straddling gear and two drive rods which go in opposite directions on the cross member 12, and braces are connected thereto and transmit movement to the drive rods 14 mounted on the side rails 6 of the sash 2. Adjacent the cross member 12, each drive rod 14 carries a locking element 15 which cooperates with a closing element 16 under the runner 9 on the casement 1. A locking element 17 in the form of a snap is spring-mounted on the free end of the drive rod 14.

In the skylight's closed setting of the sash 2 on the casement 1, the locking element 15 is in the recess 18 of the closing element 16 adjacent the front of the casement 1. In this closed setting, the tiller or arm of the handle 13 extends parallel to the longitudinal extension of the cross member 12 of the sash 2. The spindles 7 are in their uppermost setting which is shown by V in FIG. 3, and they are lying on the sliding surface 19 of the runner 9.

Figure 3:
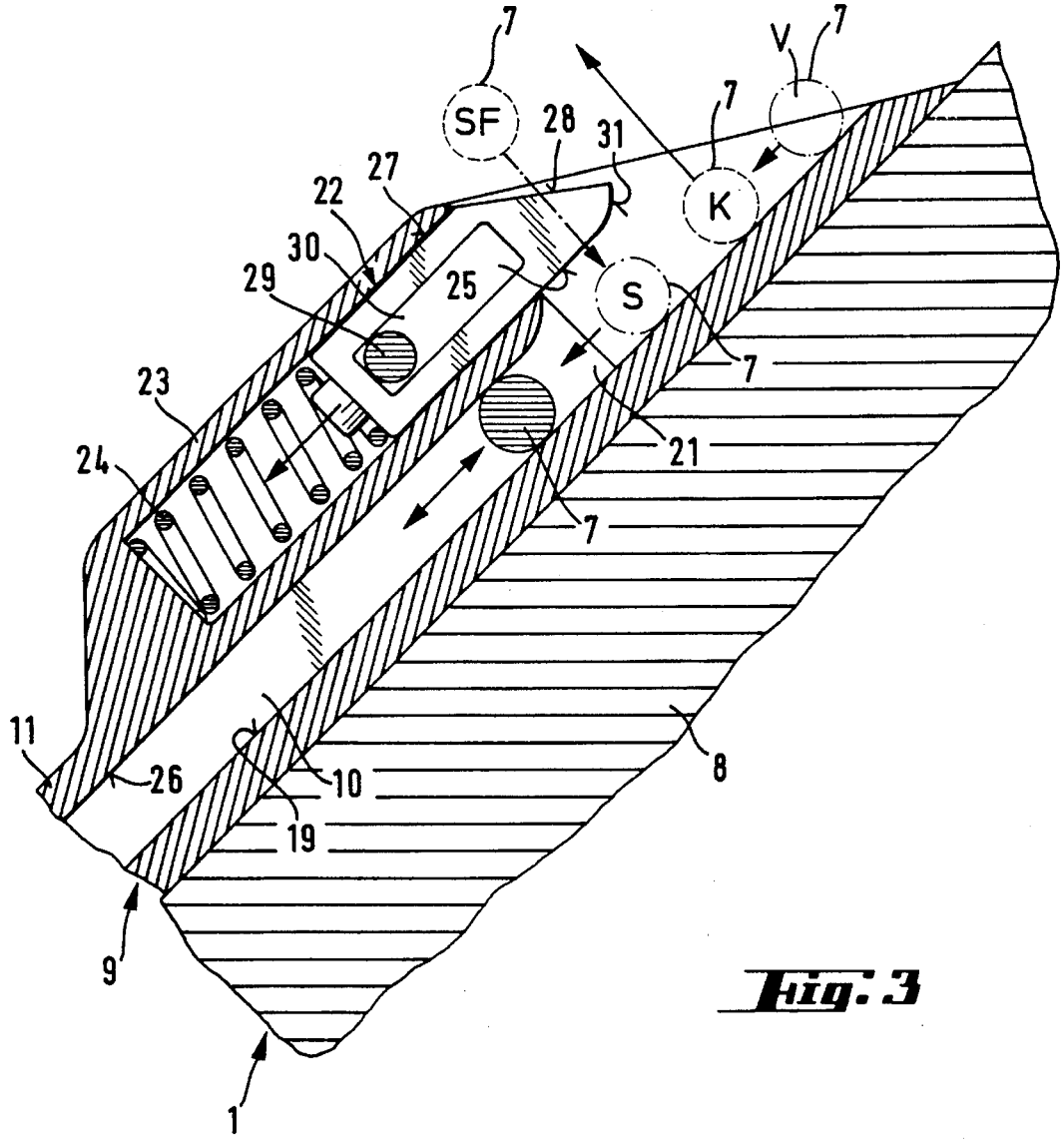
FIG. 3 is an enlarged portion of the skylight of FIG. 1 in the area of the runner groove opening.

If the handle 13 is turned 90° so that the tiller is parallel to the side rails 6 of the sash 2, the spindle 7 connected to the drive rod 14 moves on the runner 19 sliding down into the position shown by K in FIG. 3, and the locking element 15 is unlocked. The sash 2 can now be tilted open in the tilt-open setting shown in phantom line in FIG. 1, in which the carrier arms 3 move with the sash 2 synchronously on the tilt bearing 4 since the sash 2 is locked in the area of the tilt bearing 4 with the carrier arms 3 by means of the snap-type locking element 17. The direction of movement of the spindles 7 is shown by an arrow in FIG. 3. The spindles are lifted off the casement 1 unhindered when the window tilts open.

If only a slight tilt-open movement of the sash 2 is made and the handle 13 is put back in the closed setting, the sash 2 is put in a locked tilt-open ventilation setting by the locking element 15 which seats in the recess 20 in the closing element 16, and the spindles 7 are lifted easily off the surface 19 of the runner 9.

If the handle 13 is moved 180° as it comes out of the closed setting so that the handle 13 again extends parallel to the cross rail 12 but in the opposite direction, the snap-type locking part 17 is pulled back by the drive rod 14 and thus the coupling between the sash 2 and the carrier arms 3 is lifted, as is the locking of the locking element 15, and the spindles 7 are moved down to the position marked S in FIG. 3, where the spindles 7 are still outside the area of the groove 10 and the cover plate 11 of the runner 9, just before the groove opening 21. In this swinging setting of the spindles 7, the spindle 7 is overlapped by a slide 22, which can move longitudinally in a housing 23 molded in one piece on the cover plate 11 of the runner 9 under the action of the pressure spring 24.

The slide 22 has its free end projecting over the groove opening 21 and the free end reaches over the area of the swing setting of the spindle 7 and up to a point shortly before the area of the tilt setting. The bottom 25 of the slide 22 extends parallel to the guide surface 26 of the cover plate 11 which is formed by the bottom of the cover plate 11. The distance between the guide surface 26 and the bottom 25 is kept short. The top 27 of the slide 22 passes over an inclined surface 28 which extends over the entire area of the slide 22 before the groove opening 21. The path of the slide 22 is limited by a stop pin 29 on the housing 23, and the pin 29 goes through a longitudinal hole 30 in the slide 22. The surface 31 leading from the inclined surface 28 to the bottom 25 of the slide 22 is wedge-shaped.

After the spindle 7 has gone into its swing setting S as shown in FIG. 3, the slide 22 prevents the spindle 7 from being lifted off the casement 1 when the sash 2 is opened. When the sash 2 is being opened and uncoupled from the carrier arms 3, the sash 2 is moved on the pivot bearing 5 and the spindle 7 slides down on the runner 19. At the same time, the spindle 7 lifts the pivot bearing 5 off the casement 1. With these movements intersecting and affecting one another, the spindle 7 slides along the bottom 25 of the slide 22, moves on at the groove opening 21 to the guide surface 26 of the cover plate 11 and goes between the guide surface 26 and the runner 9 surface 19. A preferred swing-opening width of the sash 2 is shown by the solid lines in FIG. 1.

If the swung-open sash 2 in FIG. 1 is grasped on the top edge of the sash 2 and pushed down, the spindles 7 slide down along the groove 10 until they reach the end of the groove 32, where the cleaning position of the sash 2 is reached and in which the outside of the sash 2 is accessible from the inside of the room.

If the handle 13 is accidentally turned when the sash 2 is in the tilt-open setting of FIG. 1, the sash 2/carrier arm 3 coupling is released and the spindles 7 are pushed toward the lower cross member 12. When the sash 2 moves toward the casement 1, the spindle 7 goes into the position marked SF in FIG. 3, in the runner 9 area, shortly before the groove opening 21. The further movement towards the casement 1 makes the spindle 7 hit the inclined surface 28 of the slide 22, which is then pushed into the housing 23 against the force of the spring 24 and thus releases the path to the surface 19 of the runner 9 for the spindles 7. The spring 24 pushes the slide 22 back into its original setting. As soon as the spindle 7 has passed the slide 22 and is lying on the slide surface 19, its bottom 25 prevents the spindle 7 from being lifted off the runner 9. The spindle 7 is now in the regular swing setting and, if the sash 2 is opened, it resets itself in the correct swing-open setting of the sash 2. The slide 22 thus prevents negative effects if the handle 13 is not operated properly with the sash 2 open.

Figure 2:
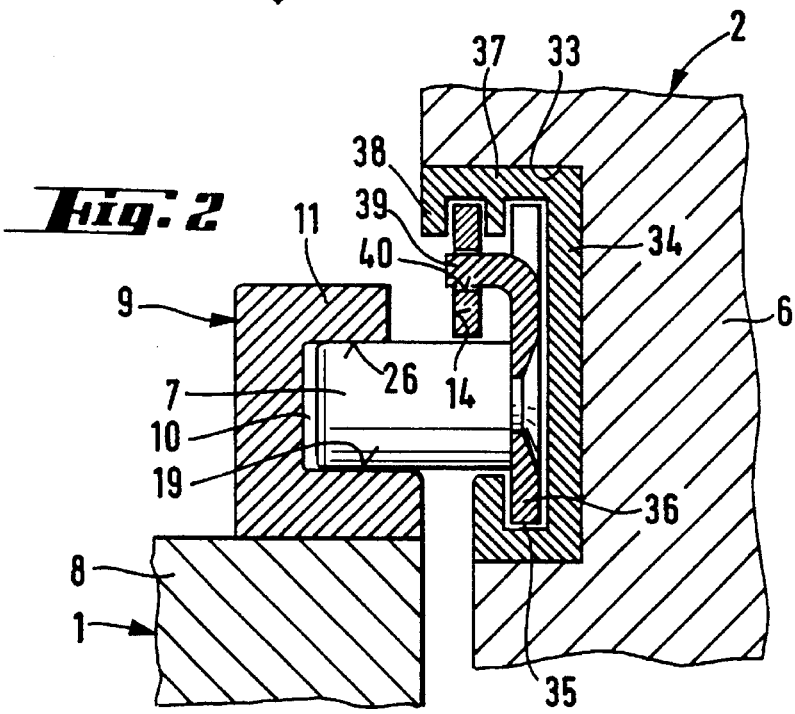
FIG. 2 is a cross section through the skylight of FIG. 1 on an enlarged scale and with the sash swung open.

As is evident from FIG. 2, which shows a cross section on an enlarged scale of the area of the spindle 7 in the groove 10 of the runner 9, a base plate 34 is recessed in a routed area 33 providing an undercut guide groove 35 in which a flange 36 is mounted so that it can move longitudinally, and the spindle 7, made of steel, is riveted or welded thereto. The base plate 34 is equipped with a longitudinal pin 37 and with a projecting catch 38 which prevents the drive rod 14 from bending under heavy stress and secures the connecting point between the drive rod 14 and the spindle 7. This is formed by a connecting pin 39 bent out of the flange 36 which interlocks in the connecting recess 40 of the drive rod 14.

Having thus described the invention, what is claimed is:

1. A skylight comprising:

(a) a sash having side rails and upper and lower cross members;

(b) a casement having side members and upper and lower cross members;

(c) carrier arms mounting the sash on the casement, said carrier arms being mounted at one end on a hinge bearing attached to the upper end of said casement and at the other end in the center of said sash on pivot bearings on said side rails of said sash, said sash having spindles on each side rail between pivot bearings and its upper cross member, said spindles being slidable in a runner that is U-shaped in cross section and is disposed on said side member of said casement;

(d) a cover plate on said sash and extending over a groove in said runner and over said spindles when said sash is in the pivoting position and, when said sash is in the closed position and the swinging position, the spindle is outwardly of the upper end of said cover plate; and (e) a handle (13) attached to said lower cross member of said sash when said sash is opened and said carrier arms are coupled with said sash, said sash tilting on the hinged bearings and, when opened with said sash uncoupled from said carrier arms, said spindles move in said grooves of said runner toward the lower cross member of said casement and said pivot bearing on the sash side of said casement is lifted off and said sash swings open, said spindles being positioned on said side rail of said sash and movable longitudinally when said spindles are seated in individual settings by movement of said handle.

2. A skylight according to claim 1 wherein said handle is attached to the lower cross member of said sash and activates a positioning gear on said cross member, and drive rods mounted on the side rails of said sash hold a locking element which cooperates with a closing element placed on one of said side members of said casement and/or with a locking element for coupling or uncoupling said sash from said carrier arms near said hinged bearings on said casement, said locking element comprising a snap on the free end of said drive rods, said drive rods also being connected to said spindles.

3. A skylight according to claim 1 wherein said spindle is attached to a flange which is mounted in an undercut guide groove of a base plate set into said side rail of said sash and disposed inwardly of said drive rod, and said base plate has a longitudinal boss which holds a catch for overlapping said drive rod in the area where said drive rod is connected to said spindle.

4. A skylight according to claim 1 wherein said cover plate of said groove of said runner ends before the upper end of said groove to provide an opening into the area of said groove in which said spindle slides in the swinging position of said sash; wherein a slide is mounted on said cover plate and by the action of a pressure spring projects beyond said groove opening adjacent the area of setting of said spindles in the hinged position of said sash; and wherein the projecting end of said slide on the top side away from said groove has an inclined surface and the bottom surface is arranged parallel to said guide surface of said cover plate for said spindles.

5. A skylight according to claim 4 wherein the surface extending from the bottom surface to the inclined surface of said slide is wedge shaped.

6. A skylight according to claim 4 wherein said slide is mounted in a housing molded on said runner, and wherein said runner and said slide are injection-molded plastic parts.

* * * * *